US006669281B1

(12) United States Patent
Huang

(10) Patent No.: US 6,669,281 B1
(45) Date of Patent: Dec. 30, 2003

(54) PULL ROD-TYPE FOLDABLE CHAIR STRUCTURE

(76) Inventor: Tsung-Chieh Huang, No. 1 Ta Yo 2 St. Ta Fa Industrial District, Kaohsiung Hsien (TW)

( * ) Notice: Subject to any disclaimer, the term of this patent is extended or adjusted under 35 U.S.C. 154(b) by 0 days.

(21) Appl. No.: 10/175,649

(22) Filed: Jun. 19, 2002

(51) Int. Cl.[7] ..... A47C 4/00

(52) U.S. Cl. ..... 297/58; 297/16.1; 297/239; 297/440.21; 297/440.22

(58) Field of Search ..... 297/58, 16.1, 56, 297/239, 59, 60, 344.18, 440.2, 440.21, 440.22, 55

(56) References Cited

U.S. PATENT DOCUMENTS 2,843,187 A * 7/1958 Manne et al. ..... 297/58
3,037,814 A * 6/1962 Gardner et al. ..... 297/440.2
6,095,597 A * 8/2000 Huang ..... 297/58
6,095,607 A * 8/2000 Wenzel ..... 297/344.18
6,131,992 A * 10/2000 Chang ..... 297/58
6,135,557 A * 10/2000 Gustafsson ..... 297/344.18
6,250,718 B1 * 6/2001 Newhouse et al. ..... 297/452.1
6,279,991 B1 * 8/2001 Atkins et al. ..... 297/16.1
6,382,715 B1 * 5/2002 Tang ..... 297/16.2
6,543,842 B2 * 4/2003 Haney ..... 297/55

* cited by examiner

*Primary Examiner*—Anthony D. Barfield
*Assistant Examiner*—Stephanie Harris
(74) *Attorney, Agent, or Firm*—Pro-Techtor International Services

(57) ABSTRACT

Pull rod-type foldable chair structure. A pull rod is telescopically inserted in the top end of the rear chair leg and pivotally connected with the front chair leg. When folding or unfolding the rear chair leg, the pull rod provides a pneumatic buffing effect. Two J-shaped lateral support boards are previously mounted on inner sides of the chair frame, whereby the seat can be directly assembled with the support boards by insertion. The back is assembled with the upper end of the front chair leg by engaging members. Therefore, the chair frame, the seat and the back can be quickly assembled. The transverse beam of the chair leg is equipped with elastic ground-contacting blocks. Therefore, the chair can be used on any floorboard made of any material such as wooden, plastic and stone floorboards. The ground-contacting block will not scrape the floorboard and the chair can be more stably placed on the ground.

6 Claims, 9 Drawing Sheets

PULL ROD-TYPE FOLDABLE CHAIR STRUCTURE

BACKGROUND OF THE INVENTION

The present invention is related to a pull rod-type foldable chair structure.

There are various kinds of foldable chairs. The early foldable chairs are made of wooden material. The later foldable chairs made of metal and plastic materials instead of the wooden material. The metal-made foldable chair has heavy weight and tends to rust. Therefore, the metal-made chair needs baking finish. This leads to high cost. Accordingly, it is trend to manufacture the chair frame of the foldable chair from aluminum alloy. However, the metal-made foldable chair has limited plasticity so that it is hard to manufacture the metal-made foldable chair with curved pattern. Therefore, it is developed to manufacture the seat and back of the foldable chair from plastic material by molding. The molded seat and back are assembled with chair frame made of metal or aluminum alloy so as to achieve solid curved pattern of the chair.

However, the conventional foldable chairs still have some shortcomings as follows:

1. The foldable chair lacks buffing design. Therefore, when folding or unfolding the foldable chair, the front and rear chair legs often instantaneously stretches or collapses. Therefore, a user, especially a child is very easy to be clamped and injured by the foldable chair.
2. In the case that the foldable chair is equipped with an oil cylinder to avoid instantaneous folding or unfolding, the cost will be too high and the foldable chair will have too heavy weight.
3. It is troublesome to assemble the seat and back with the chair frame of the foldable chair. Moreover, the fixing screws often protrude from the chair frame to ruin the appearance of the chair.
4. It is troublesome to assemble the seat and back of the foldable chair so that the production efficiency is lowered.
5. When stored, generally the foldable chairs are upright leant on each other. Therefore, the foldable chairs will occupy much room.
6. The foldable chairs cannot be horizontally stacked. In the case that the foldable chairs are horizontally stacked, they tend to slip and fall down. This may lead to damage of the chairs or even injury of persons.
7. The ground-contacting blocks of the foldable chair are hard. Such hard ground-contacting blocks tend to scrape wooden and plastic floorboard.
8. The frictional force between the hard ground-contacting blocks of the foldable chair and the ground is weak. Therefore, the foldable chair tends to slip on the ground.

SUMMARY OF THE INVENTION

It is therefore a primary object of the present invention to provide a pull rod-type foldable chair structure in which the chair frame, the seat and the back can be quickly assembled. The transverse beam of the chair leg is equipped with elastic ground-contacting blocks. Therefore, the chair can be used on any floorboard made of any material such as wooden, plastic and stone floorboards. The ground-contacting block will not scrape the floorboard and the chair can be more stably placed on the ground.

The present invention can be best understood through the following description and accompanying drawings wherein:

DETAILED DESCRIPTION OF THE PREFERRED EMBODIMENT

Figure 1:
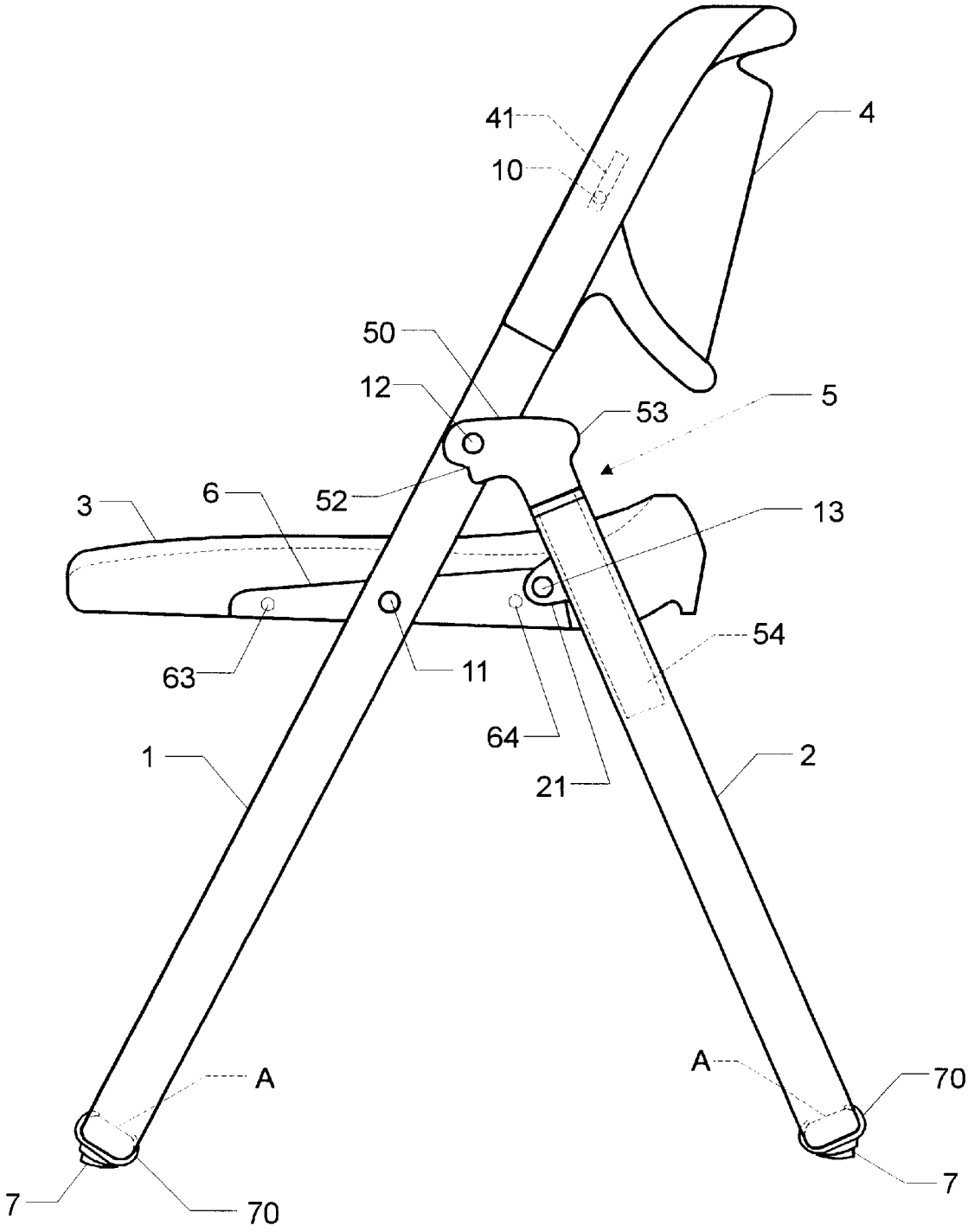
FIG. 1. is a side view of the present invention.
Figure 2:
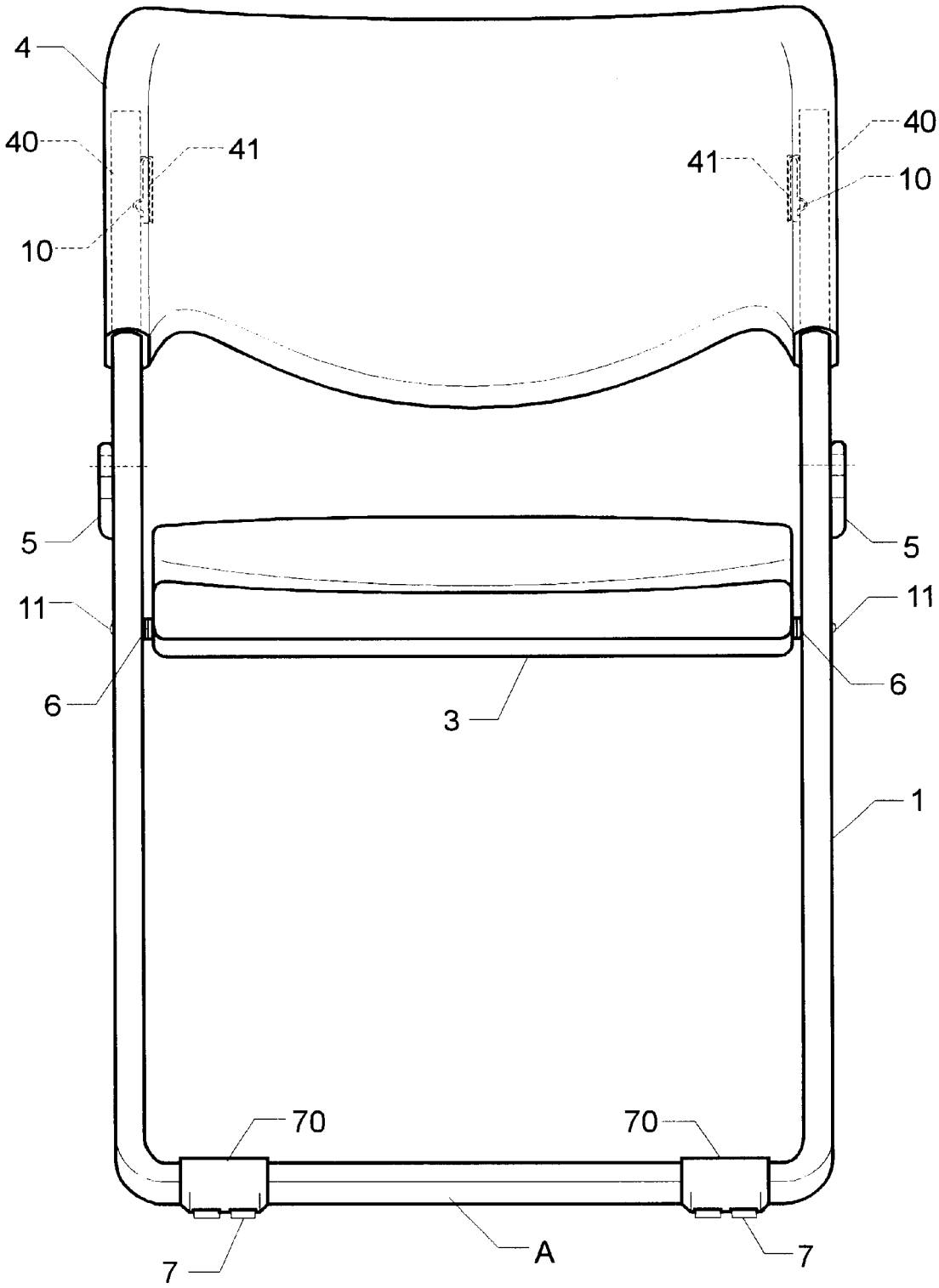
FIG. 2. is a front view of the present invention.
Figure 3:
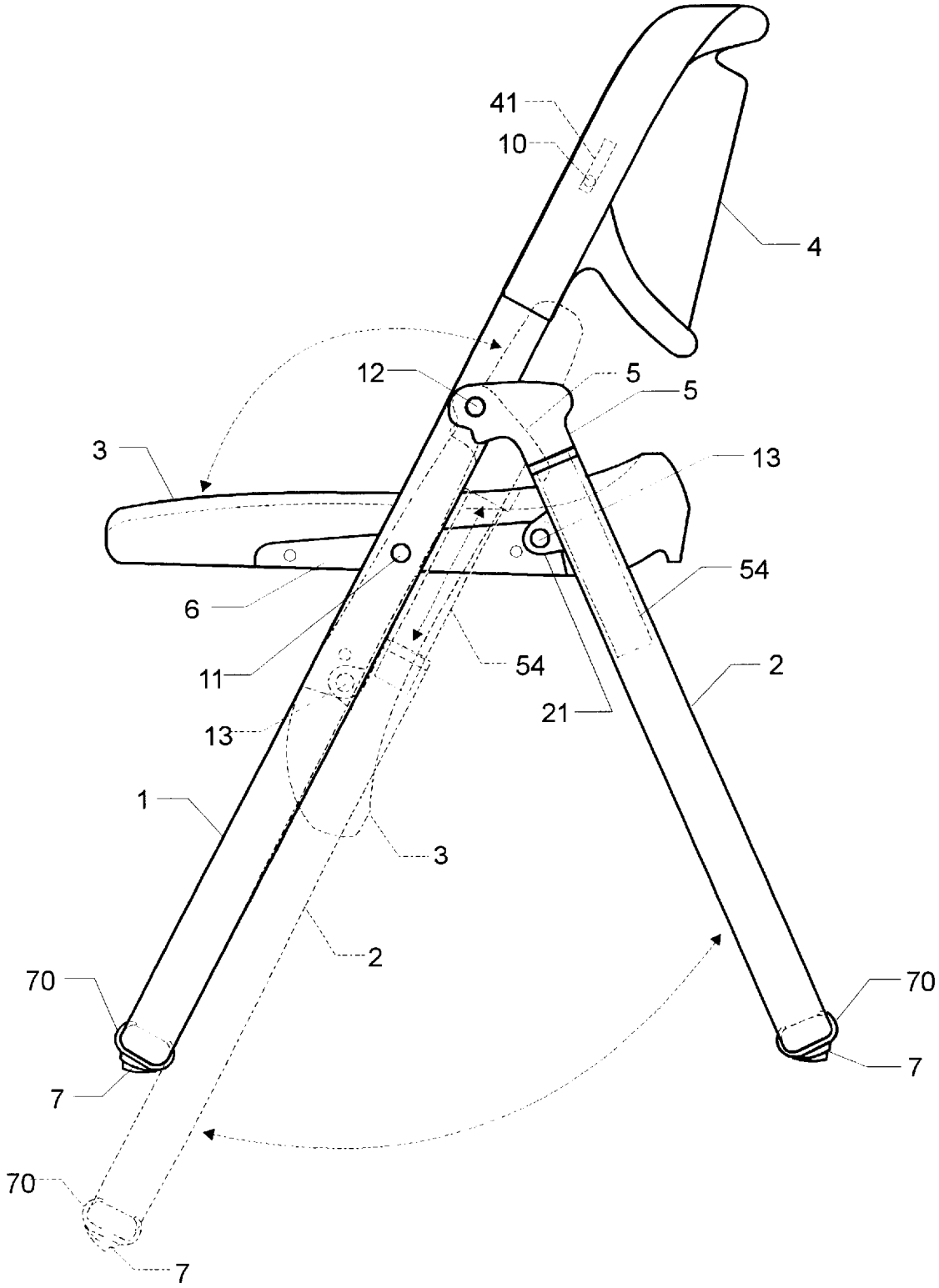
FIG. 3. is a side view of the present invention, showing the folding thereof.
Figure 4:
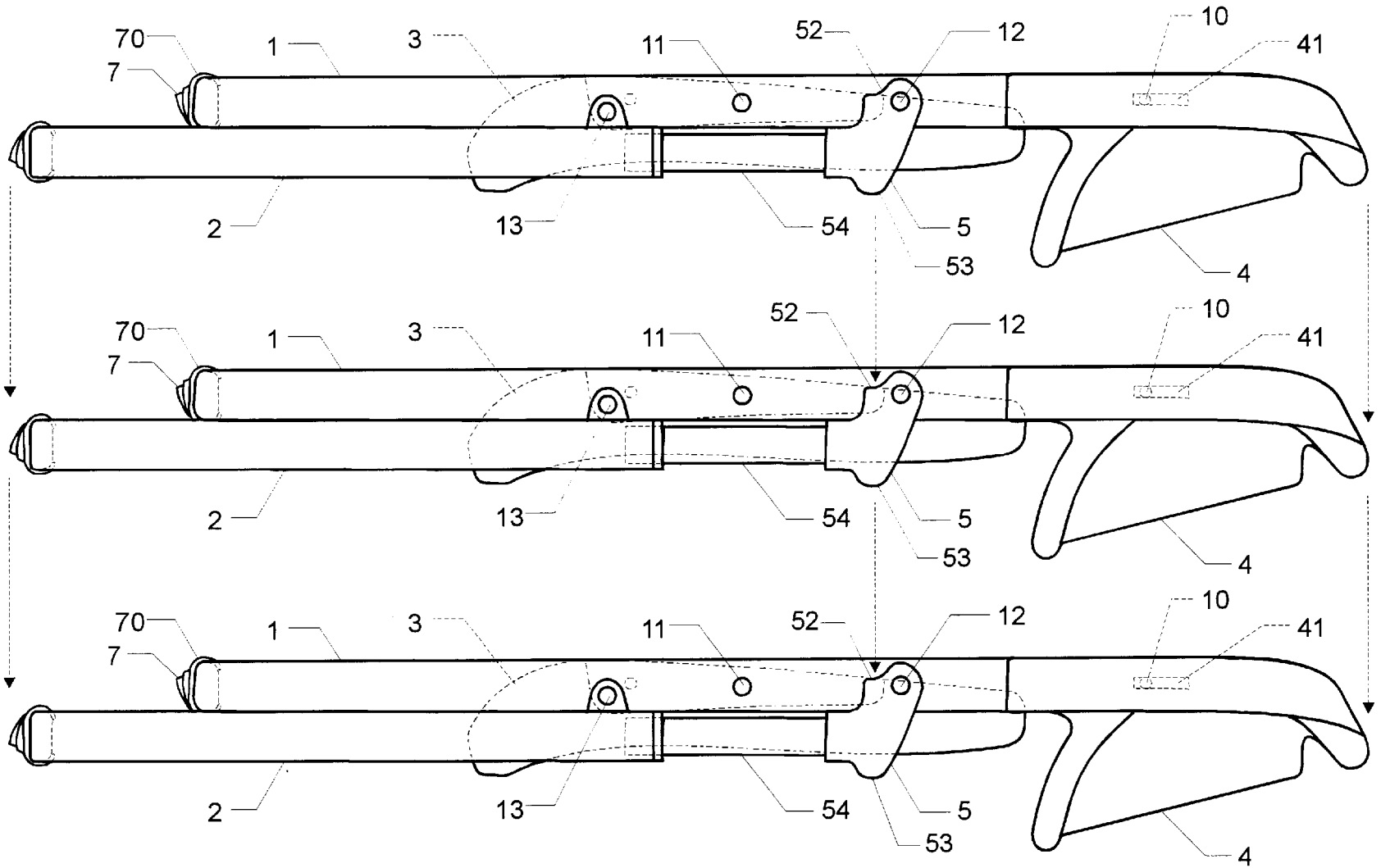
FIG. 4. shows that the foldable chairs of the present invention is horizontally stacked.
Figure 6:
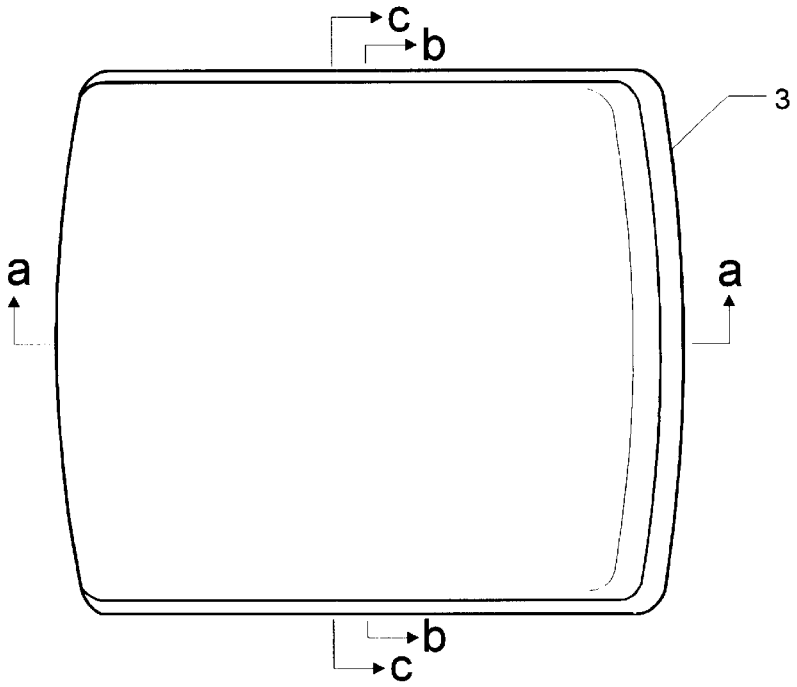
FIG. 6. is a top view of the seat of the present invention.

Please refer to FIGS. 1 to 3. The present invention includes a front chair leg 1, a rear chair leg 2, a seat 3, a back 4, two pull rods 5, two support boards 6 and ground-contacting blocks 7.

The bottom transverse beam of the front chair leg 1 is provided with ground-contacting blocks 7 and ground-contacting block seat bodies 70 coupled with the ground-contacting blocks 7. Via a pivot member 11, the inner side of middle section of the front chair leg 1 is pivotally connected with a pivot hole 61 near the middle section of the support board 6. The outer or inner side of upper section of the front chair leg is formed with engaging holes 10 for engaging with the back 4. Via a pivot member 12, the outer side of the front chair leg 1 between the pivot member 11 and the back 4 is pivotally connected with the pull rod 5 telescopically inserted in the top section of the rear chair leg 2.

The bottom transverse beam of the rear chair leg 2 is provided with ground-contacting blocks 7 and ground-contacting block seat bodies 70 coupled with the ground-contacting blocks 7. The inner side of front edge of the rear chair leg 2 is provided with a pivot board 21 which via a pivot member 13 is pivotally connected with a pivot hole 62 of the rear section of the support board 6.

Figure 5:
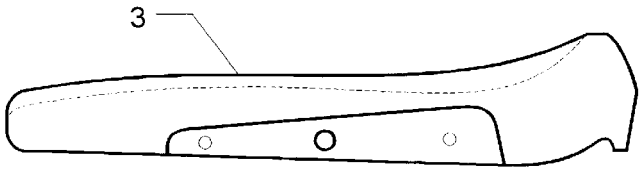
FIG. 5. is a side view of the seat of the present invention.
Figure 7:
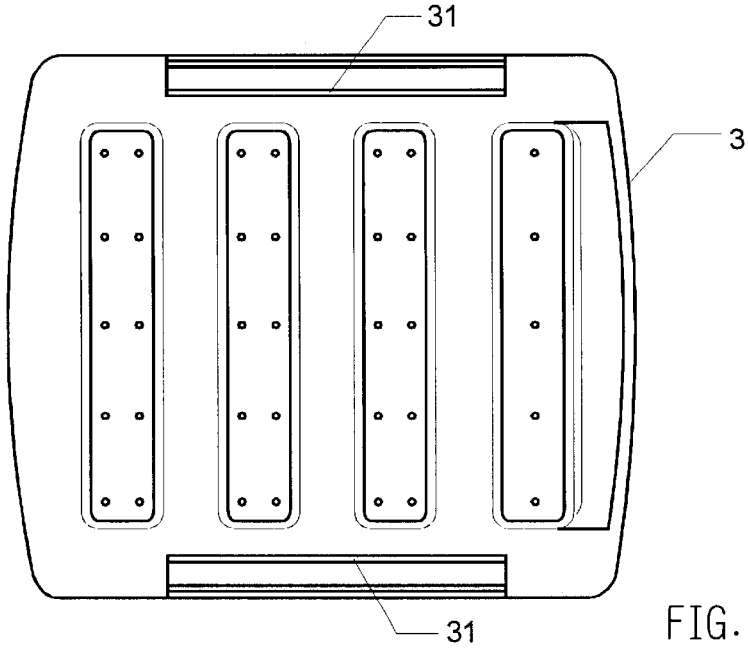
FIG. 7. is a bottom view of the seat of the present invention.
Figure 8:
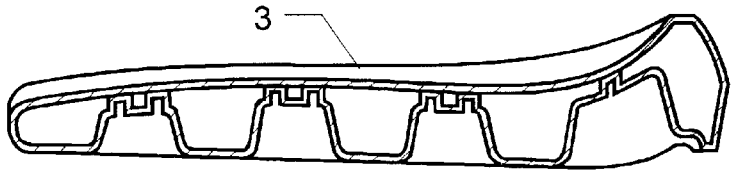
FIG. 8. is a sectional view taken along line a—a of FIG. 6.
Figure 9:
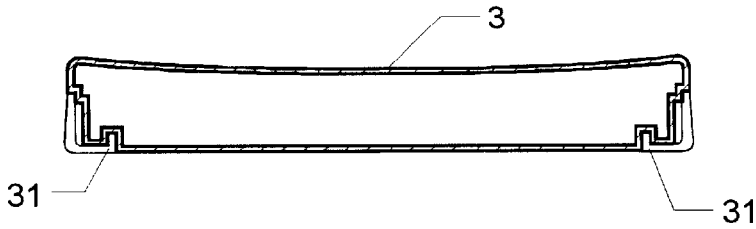
FIG. 9. is a sectional view taken along line b—b of FIG. 6.
Figure 10:
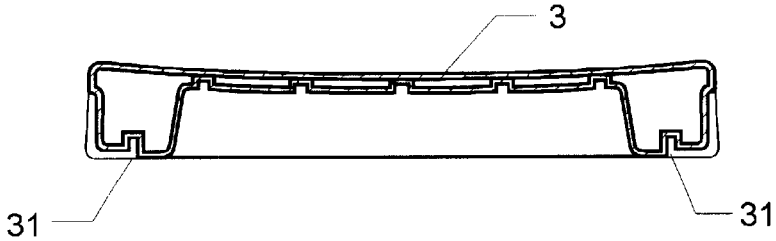
FIG. 10. is a sectional view taken along line c—c of FIG. 6.

Referring to FIG. 5, the seat 3 is made by molding. The bottom of two sides of the seat 3 is formed with insertion grooves 31. The insertion hooks of the J-shaped support boards 6 are inserted in the insertion grooves 31. The lateral walls of the support boards 6 are formed with through holes 63, 64. Fixing members such as screws are passed through the through holes 63, 64 to fix the support boards 6 with the seat 3.

Figure 11:
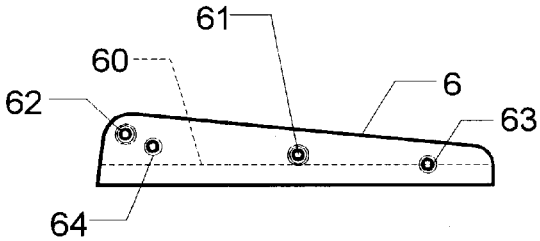
FIG. 11. is a side view of the support board of the present invention or assembling the seat with the chair frame.
Figure 12:
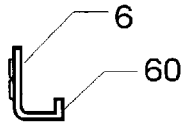
FIG. 12. is a rear view of the support board of the present invention.
Figure 13:
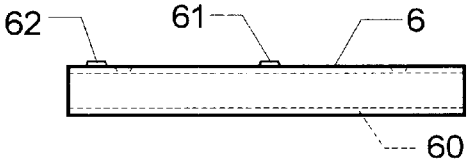
FIG. 13. is a top view of the support board of the present invention.
Figure 14:
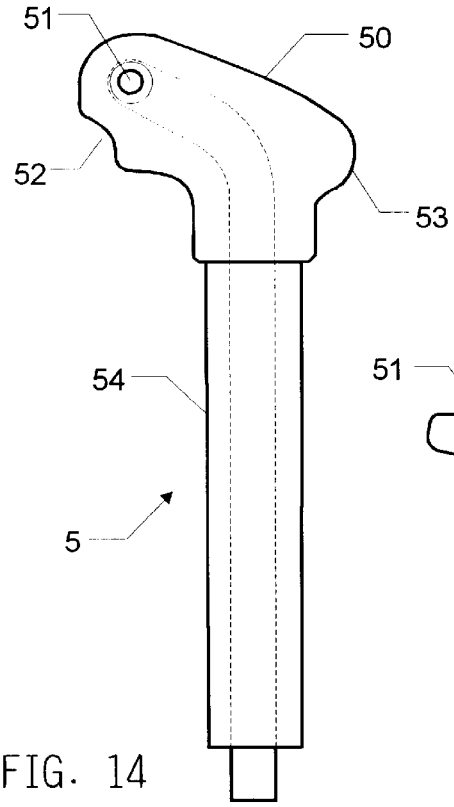
FIG. 14. is a side view of the right pull rod of the rear chair leg of the present invention.
Figure 15:
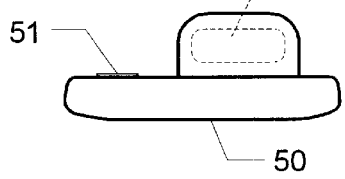
FIG. 15. is a top view of the right pull rod of the rear chair leg of the present invention.
Figure 16:
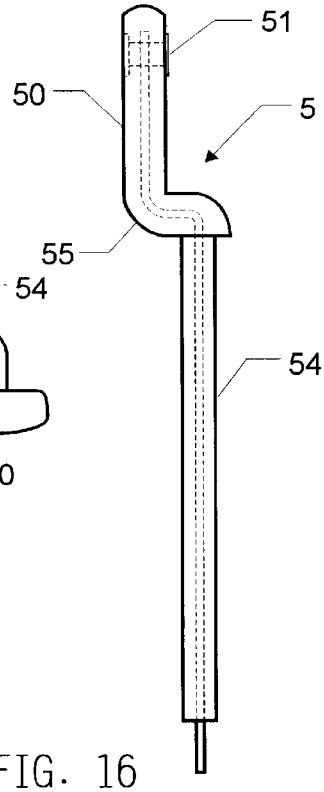
FIG. 16. is a rear view of the right pull rod of the rear chair leg off the present invention.
Figure 19:
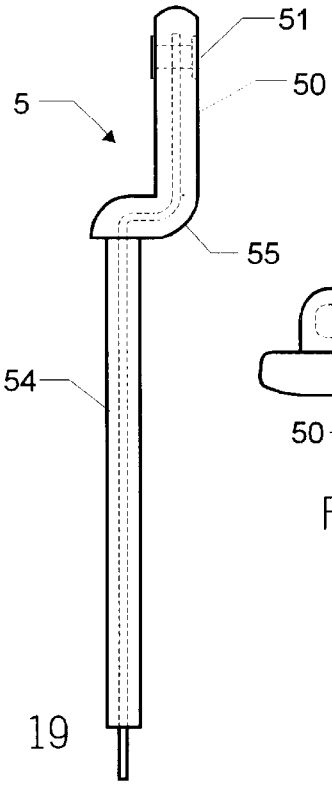
FIG. 19. is a rear view of the right pull rod of the rear chair leg of the present invention.
Figure 18:
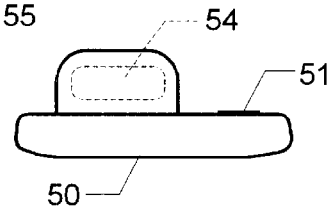
FIG. 18. is a top view of the left pull rod of the rear chair leg of the present invention.
Figure 17:
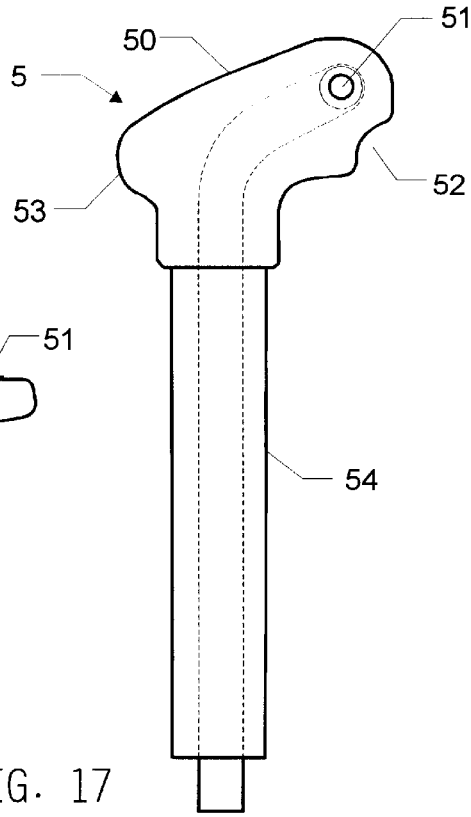
FIG. 17. is a side view of the left pull rod of the rear chair leg of the present invention.
Figure 22:
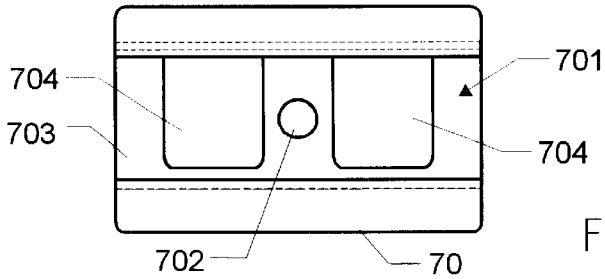
FIG. 22. is a top view according to FIG. 20.
Figure 21:
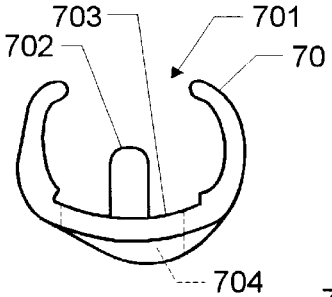
FIG. 21. is a left view according to FIG. 20.
Figure 20:
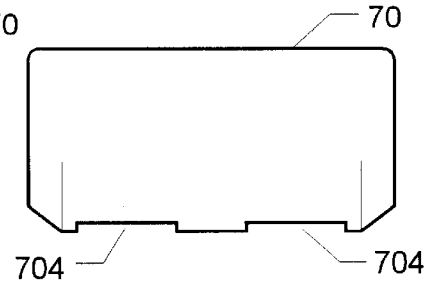
FIG. 20. shows the ground-contacting block seat body of the present invention.
Figure 23:
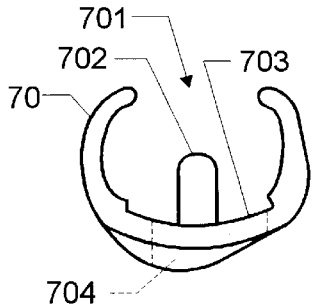
FIG. 23. is a right view according to FIG. 20.
Figure 24:
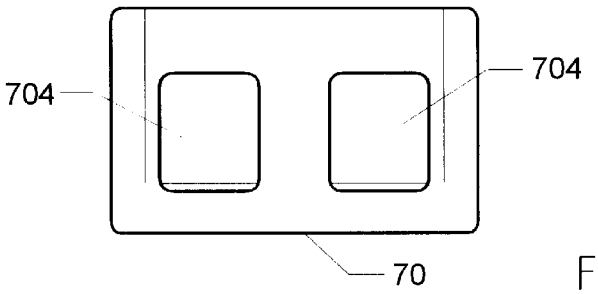
FIG. 24. is a bottom view according to FIG. 20.
Figure 26:
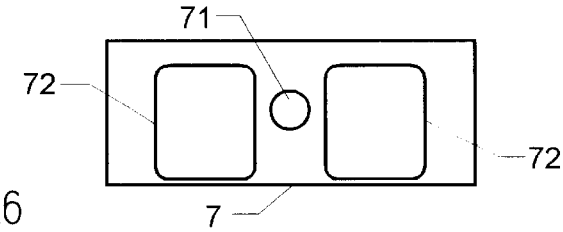
FIG. 26. is a top view according to FIG. 25.
Figure 25:
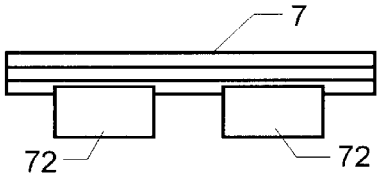
FIG. 25. shows the ground-contacting block of the present invention.
Figure 27:
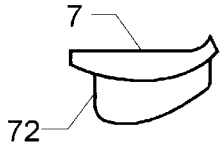
FIG. 27. is a right view according to FIG. 25.
Figure 28:
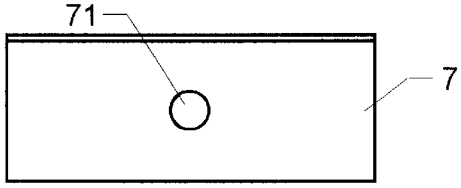
FIG. 28. is a bottom view according to FIG. 25.

Referring to FIGS. 11 to 13, the support board 6 is substantially J-shaped. The inner edge of bottom wall of the support board 6 is bent to form an insertion wall 60 for inserting into the insertion groove 31 of the seat 3. The support board 6 is formed with two through holes 63, 64 for fixing the seat 3 and a pivot hole 61 for pivotally connecting with the front chair leg 1 and a pivot hole 62 for pivotally connecting with the pivot board 21 of the rear chair leg 2.

Referring to FIGS. 1 and 2, two sides of the back 4 are formed with assembling cavities 40 for two lateral leg rods of the front chair leg 1 to insert therein. A resilient engaging member 41 is disposed in each assembling cavity 40. The engaging member 41 is engaged in the engaging hole 10 of the leg rod of the front chair leg 1, whereby the back 4 can be quickly and easily assembled with the front chair leg 1.

Referring to FIGS. 14 to 19, the left and right pull rods 5 are symmetrical to each other. The upper end of the pull rod 5 is a pivot head 50 formed with a pivot hole 51 for pivotally connecting with the pivot member 12 of the front chair leg 1. The front lower edge of the pivot head 50 is formed with a locating recess 52. The rear end of the pivot head 50 is formed with a locating projecting block 53. The locating projecting block 53 of the pivot head 50 of the pull rod 5 of one foldable chair can be placed and located in the locating recess 52 of the pivot head 50 of the pull rod 5 of another foldable chair. The pivot head 50 and the telescopic rod body 54 of the pull rod 5 contain a bending angle. Moreover, a bending neck section 55 is formed between the pivot head 50 and the telescopic rod 54. When the telescopic rod 54 is telescopically inserted in the top opening of the rear chair leg 2, the pivot head 50 at upper end of the pull rod 5 is bent outward and leant on outer side of the front chair leg 1.

Figure 29:
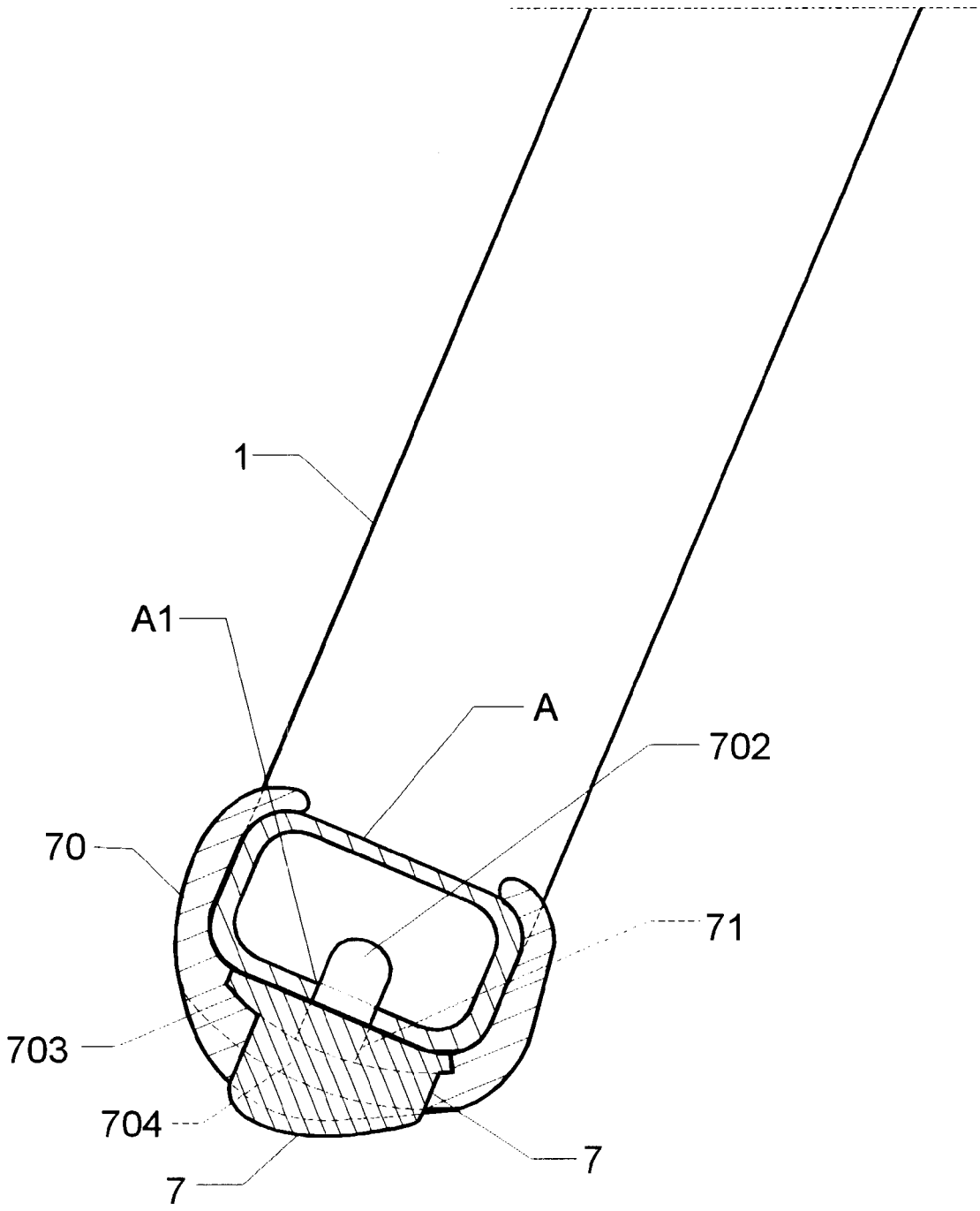
FIG. 29. is a sectional view of the assembly of the ground-contacting block and ground-contacting block seat body of the present invention.

Referring to FIGS. 20 to 24, the ground-contacting block seat body 70 has a holding mouth 701 facing upward for holding the transverse beam of the chair leg. An insertion post 702 is formed in the seat body 70 for inserting into a locating hole A1 of the bottom of the transverse beam A as shown in FIG. 29. In addition, the inner face of the bottom of the seat body 70 is formed with a dented face 703. The ground-contacting block 7 having elasticity and hardness softer than the seat body 70 is positioned in the dented face 703. The bottom of the seat body 70 is formed with at least one perforation 704. The projecting block 72 of the ground-contacting block 7 protrudes through the perforation 704 from the bottom of the seat body 70 for contacting with the ground.

Referring to FIGS. 25 to 28, the ground-contacting block 7 is formed with a through hole 71 for the insertion post 702 of the dented face 703 of the seat body 70 to pass therethrough. At least one projecting block 72 downward protrudes from the bottom of the ground-contacting block 7. The projecting block 72 is fitted through the perforation 704 of the seat body 70 to protrude from the bottom of the seat body 70 for contacting with the ground. The ground-contacting block 7 is fixedly clamped between the dented face 703 of the seat body 70 and the transverse beam of the chair leg. The insertion post 702 is fitted through the ground-contacting block 7 and inserted in the locating hole A1 of the transverse beam A so as to firmly assemble the ground-contacting block 7 with the seat body 70 and the transverse beam A.

According to the above arrangement, the present invention has the following advantages:

1. The rear chair leg is pivotally connected with the front chair leg via the pull rod. Therefore, when folding or unfolding the rear chair leg, the pull rod 5 provides a pneumatic buffing effect.
2. The pivot head 50 of the pull rod 50 is formed with a locating recess 52 and a locating projecting block 53. When the chairs are horizontally stacked, the locating projecting blocks 53 and the locating recesses 52 of the chairs are engaged with each other. Therefore, the chairs are stably and safely located without slippage.
3. It is convenient and quick to assemble the seat 3, the support boards 6, the front chair leg 1 and the rear chair leg 2. Therefore, the production efficiency of the chair is high and the manufacturing cost is lowered.
4. The back 4 is engaged and assembled with the front chair leg 1 by the engaging member 41 without using any screw. Therefore, the problem of protrusion of the screw is avoided and the back 4 can be quickly and easily assembled with the front chair leg 1.
5. The seat body 70 is hard so that it is firmly assembled with the chair leg without easy detachment. The softer and elastic ground-contacting block 7 is directly located in the seat body 70 and protrudes therefrom for contacting with the ground. Therefore, the ground-contacting block 7 will not scrape the floorboard and the frictional force between the ground-contacting block 7 and the ground is greater. Moreover, the ground-contacting block 7 can more stably attach to the ground.
6. The quality of the chair is better.
7. The safety in use of the foldable chair is ensured.

The above embodiment is only used to illustrate the present invention, not intended to limit the scope thereof. Many modifications of the above embodiment can be made without departing from the spirit of the present invention.

What is claimed is:

1. Pull rod-type foldable chair structure comprising a front chair leg, a rear chair leg, a seat, a back, two pull rods, two support boards and ground-contacting blocks, wherein:

the bottom transverse beam of the front chair leg is provided with ground-contacting blocks and ground-contacting block seat bodies coupled with the ground-contacting blocks, via a pivot member, an inner side of middle section of the front chair leg being pivotally connected with a pivot hole near a middle section of the support board, one side of upper section of the front chair leg being formed with engaging holes for engaging with the back, via a pivot member, an outer side of the front chair leg between the pivot member and the back being pivotally connected with the pull rod inserted in a top section of the rear chair leg;

the pull rod is telescopically inserted in the top end of the rear chair leg, the pull rod being pivotally connected with the front chair leg, the bottom transverse beam of the rear chair leg being provided with ground-contacting blocks and ground-contacting block seat bodies coupled with the ground-contacting blocks, the rear chair leg being provided with a pivot board which via a pivot member is pivotally connected with a pivot hole of the rear section of the support board assembled with the seat;

the bottom of two sides of the seat is formed with insertion grooves, the insertion hooks of the two lateral support boards being inserted in the insertion grooves, the lateral walls of the support boards being formed with through holes, fixing members being passed through the through holes to fix the support boards with the seat;

an inner edge of bottom wall of the support board is bent to form an insertion wall for inserting into the insertion groove of the seat, the support board being formed with two through holes for fixing the seat and a pivot hole for pivotally connecting with the front chair leg and a pivot hole for pivotally connecting with the pivot board of the rear chair leg;

two sides of the back are formed with assembling cavities for two lateral leg rods of the front chair leg to insert therein, a resilient engaging member being disposed in each assembling cavity, the engaging member being engaged in the engaging hole of the leg rod of the front chair leg, whereby the back can be quickly and easily assembled with the front chair leg; and the upper end of the pull rod is a pivot head formed with a pivot hole for pivotally connecting with the pivot member of the front chair leg, a front lower edge of the pivot head being formed with a locating recess, a rear end of the pivot head being formed with a locating projecting block, whereby the locating projecting block of the pivot head of the pull rod of one foldable chair can be placed and located in the locating recess of the pivot head of the pull rod of another foldable chair.

2. Pull rod-type foldable chair structure as claimed in claim 1, wherein a telescopic rod body of the pull rod is inserted in the top opening of the rear chair leg, the pivot head of the upper end of the pull rod being bent outward and leant on outer side of the front chair leg.

3. Pull rod-type foldable chair structure as claimed in claim 1, wherein the pivot head and the telescopic rod body of the pull rod contain a bending angle, a bending neck section being formed between the pivot head and the telescopic rod body.

4. Pull rod-type foldable chair structure as claimed in claim 1, wherein the ground-contacting block seat body has a holding mouth facing upward, an insertion post being formed in the seat body for inserting into a locating hole of the bottom of the transverse beam of the chair leg, an inner face of the bottom of the seat body being formed with a dented face, the ground-contacting block having elasticity and hardness softer than the seat body being positioned in the dented face, the bottom of the seat body being formed with at least one perforation, a projecting block of the ground-contacting block protruding through the perforation from the bottom of the seat body for contacting with the ground.

5. Pull rod-type foldable chair structure as claimed in claim 1, wherein the ground-contacting block is formed with a through hole for the insertion post of the dented face of the seat body to pass therethrough, at least one projecting block downward protruding from the bottom of the ground-contacting block, the projecting block being fitted through the through the perforation of the seat body to protrude from the bottom of the seat body for contacting with the ground.

6. Pull rod-type foldable chair structure as claimed in claim 1, wherein the lateral wall of the support board is fixed on the seat.

* * * * *